United States Patent [19]

Baldi

[11] 3,948,687

[45] Apr. 6, 1976

[54] HIGH TEMPERATURE RESISTANT DIFFUSION COATING

[75] Inventor: Alfonso L. Baldi, Drexel Hill, Pa.

[73] Assignee: Alloy Surfaces Company, Inc., Wilmington, Del.

[22] Filed: May 7, 1973

[21] Appl. No.: 357,616

Related U.S. Application Data

[63] Continuation-in-part of Ser. Nos. 304,220, Nov. 26, 1972, and Ser. No. 254,403, May 18, 1972, Pat. No. 3,785,854, and Ser. No. 219,514, Jan. 20, 1972, Pat. No. 3,801,357, and Ser. No. 90,682, Nov. 18, 1970, Pat. No. 3,764,371, said Ser. No. 219,514, and Ser. No. 90,682, each is a continuation-in-part of Ser. No. 837,811, June 30, 1969, abandoned.

[52] U.S. Cl. ..... 148/6.16; 148/6.27; 427/203

[51] Int. Cl.[2] ..... C23F 7/14

[58] Field of Search ..... 148/6.16, 6.27; 117/107.2 P, 132 CF; 427/190, 203, 258

[56] References Cited

UNITED STATES PATENTS

| | | | |
|---|---|---|---|
| 2,562,118 | 7/1951 | Osdal | 148/6.16 |
| 2,619,443 | 11/1952 | Robinson | 117/132 CF |
| 2,707,703 | 5/1955 | Dorst | 117/132 CF |
| 3,096,160 | 7/1963 | Puyear | 117/107.2 P |
| 3,248,249 | 4/1966 | Collins | 148/6.16 X |
| 3,284,319 | 11/1966 | Hill | 148/6.16 X |
| 3,286,684 | 11/1966 | Aves | 117/107.2 P |

*Primary Examiner*—Ralph S. Kendall
*Assistant Examiner*—Charles R. Wolfe, Jr.
*Attorney, Agent, or Firm*—Connolly and Hutz

[57] ABSTRACT

Low temperature aluminum diffusion is more uniform when effected with a pack energized by aluminum chloride or other material that does not generate nitrogen, and gives food protection against marine corrosion of steels, and particularly when there is a chromate-type coating applied over the aluminizing. Highly effective chromate-type coating mixture consists essentially of aqueous solution of chromic and phosphoric acid also containing magnesium salts of said acids and dispersed polytetrafluoroethylene particles. Such coating mixture is best applied over porous pre-coating of colloidal inert particles. Aluminized superalloy can be heated in air to whiten it, then cleaned to give product having more ductile case. Such coated superalloy can also be stripped of coating by aqueous $HNO_3$—HF—$CrO_3$ bath.

4 Claims, No Drawings

HIGH TEMPERATURE RESISTANT DIFFUSION COATING

This application is in part a continuation of applications Ser. No. 304,220 filed Nov. 26, 1972, Ser. No. 254,403 filed May 13, 1972 (U.S. Pat. No. 3,785,854 granted Jan. 15, 1974), Ser. No. 291,514 filed Jan. 20, 1972 (U.S. Pat. No. 3,801,357 granted Apr. 2, 1974), and Ser. No. 90,682 filed Nov. 18,1970 (U.S. Pat. No. 3,764,371 granted Oct. 9, 1973). The last two of these prior applications are in turn continuations-in-part of application Ser. No. 837,811 filed June 30, 1969 and subsequently abandoned.

The present invention relates to the coating of metals to make them more resistant to exposure.

Among the objects of this invention is the provision of improved coating mixtures and techniques effective to increase the resistance of steels to marine atmospheres and particularly at elevated temperatures.

Additional objects of the present invention include more weather-resistant coated metals, such as parts of jet engine compressors.

The foregoing as well as other objects of the present invention will be more fully understood from the following description of several of its exemplifications.

The aluminizing of metals by a diffusion coating process is known to improve the resistance of the metals to exposure. A high temperature aluminizing of this kind is shown for example in U.S. Pat. No. 3,257,230 and in Canadian Patent No. 806,618. This is a complex type of aluminizing.

A good form of simple aluminizing is accomplished with a pack consisting of 70% alumina and 30% aluminum, both −325 mesh, activated with ½% aluminum chloride, using a coating temperature of 850°F for 20 hours. Another good example of a pack contains 80% of the alumina and 20% of the aluminum powder, with the same activator in the same concentration, used at 800°F. It is particularly desirable to keep the temperature below about 1000°, better still below about 900°F during this coating treatment and the aluminizing can be carried out in any other form of diffusion-coating apparatus. The coating produced by a simple aluminizing pack gives better results when the pack has been previously used in a coating run. It is accordingly helpful when starting with a fresh pack to give it a break-in treatment with a dummy work piece, or even with no work piece at all.

The simple aluminizing described above does not produce a consistently uniform coating when an ammonium halide is used as the energizer and the material being coated is an age-hardenable or a martensitic stainless steel. The lack of uniformity appears to be due to the presence of nitrogen in the retort atmosphere during the coating, and the resultant erratic formation of nitrides. The aluminum chloride energizer does a good job of flushing out residual air without introducing nitrogen, but other energizers such as elemental iodine and bromine, iodine trichloride or similar nitrogen-free halogen compounds including other higher halides of aluminum (chloride, bromide or iodide), halides of silicon, colombium, titanium, boron, zirconium, hafnium, tantalum, chromium, molybdenum, tungsten, iridium, osmium, platinum, gallium, germanium, tin and phosphorus will do the same although they are not preferred. Whichever energizer is used is preferably in an amount from about 0.1 to about 1% of the pack weight. Also better results are obtained if the unvaporized energizer is isolated from the work pieces as by enclosing all the energizer in a container that permits the escape of vapor. A container for this purpose can be made of fine screening or with an open top or with a loosely fitted top and several of such containers can be distributed throughout the mix. Such a container or plurality of containers can be embedded in the coating pack and will release vapors of energizer as the pack is heated up to coating temperature, such vapors accomplishing the same flushing and deposit-accelerating results expected of an energizer, but without the coating flaws experienced when solid aluminum chloride is mixed into the entire pack. The container holding the energizer can be made of aluminum, plain carbon steel or other suitable metal such as aluminized steel or low alloy chromium steel, or even martensitic stainless steel, and the energizer contained in it can also be mixed with an excess of inert materials like alumina, or of pack mixture. The energizer is preferably anhydrous, but can also be partially or completely hydrated. The retort itself can be made of any of the foregoing steels.

As an alternative packing technique all the energizer can be confined to a stratum of the pack below the work pieces, with the remainder of the pack being a uniform mixture of filler and diffusing material. Thus good results are obtained when the diffusion retort is first packed with about a ½ to 1 inch deep layer of the pack material, all the energizer is then sprinkled over that layer, another 1 inch deep layer of energizer-free pack placed over the foregoing, and the retort then filled with work pieces and additional pack. However it is simpler to pack the retort with the separately contained energizer, and work pieces cannot be inadvertently inserted in such a separately contained energizer. Should a work piece be accidentally pushed into the separately stratified energizer of the alternative packing technique, a good coating will not form on the portion of the work piece that has penetrated into that stratum.

In general the simple aluminizing as well as the more complex aluminizing are effectively used to cause an aluminum pick-up of about 0.5 to 7.5 milligrams per square centimeter of surface coated, giving a coating case about 0.1 to about 1.5 mils thick. A preferred pick-up range is from about 1 to about 5 milligrams per square centimeter. The coating packs used can be replenished as by adding 1% aluminum after every use, even after a break-in use.

A useful diffusion aluminizing of stainless steel and chromium steels is also effected by incorporating with the aluminum about one-fourth to three-fourths metallic manganese calculated on the weight of the aluminum. Thus a diffusion coating pack of 60% alumina, 30% aluminum and 10% manganese will give at 875°F over a period of ten hours an aluminized coating on age-hardenable or martensitic stainless steels that provides good protection, particularly against marine-type corrosion. Type 410 stainless steel jet engine compressor blades or gas generator housings given a 0.3 to 1 mil thick coating case from a manganese-free aluminum pack at temperatures from 800° to 1100°F will however withstand corrosion in salt air for a particularly long period of time.

A chromate-type coating applied over the manganese-containing aluminum diffusion coating or the manganese-free aluminum coating, further increases corrosion resistance. A particularly effective chromate-type coating for this purpose is one that is made by dipping the aluminized compressor blade after vapor honing to clean the surface, into an aqueous solution of phosphoric acid and chromic acid containing per liter about 5 to 100 grams phosphoric acid and about 1 to 25 grams chromic acid, removing the dipped blade and permitting the solution to drain, followed by calcining the blade with the residual coating solution thereon at 800°F for ten minutes. So-called conversion coatings such as described in U.S. Pat. No. 3,385,738 are not sufficiently protective at elevated temperatures, that is at about 800°F or higher. The chromic acid-phosphoric acid coatings of U.S. patent application Ser. No. 90,682 with or without the related treatments there disclosed are much better in this respect and provide protection at temperatures that reach as high as 1200°F.

Very effective results on aluminized greek ascoloy are obtained with 10 to 15 grams $CrO_3$ and 57 grams orthophosphoric acid per liter, the calcining being at 600°F for 40 minutes. In general calcining temperatures can vary from about 450° to about 900°F, and should be long enough to cause the chromate-type coating to become almost completely (at least about 90%) insoluble in water.

Even better results are obtained with age-hardenable and martensitic stainless steels when the chromate-type coating also contains magnesium as well as particles of polytetrafluoroethylene, as in the following Examples:

EXAMPLE I 180 grams $CrO_3$
130 grams MgO
410 cc 85% $H_3PO_4$ (by weight in water)
15 cc aqueous dispersion of polytetrafluoroethylene particles less than 1 micron in size, containing 13.5 grams of the resin, and
Water to make up 3 liters of coating bath.

The MgO dissolves in the acid and remains dissolved upon dilution, while the resin particles remain undissolved but dispersed. If the stock resin dispersion is sensitive to acid, it is added after the MgO is dissolved inasmuch as this sharply lowers the acidity. The resin particles need not be very stably dispersed, although such stability is improved through the use of a small amount of a dispersing agent that is not sensitive to acid or oxidizers. Non-ionic surface-active agents or quaternized imidazoline surface-active agents such as

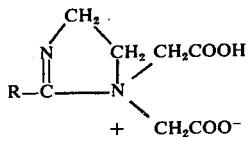

are suitable for this purpose. In any event the bath can be agitated to assure uniformity of dispersion.

Dipping an aluminized greek ascoloy compressor blade in the bath of this example at room temperature, followed by oven heating at 700°F for 60 minutes provides a cured coating weighing about 0.27 milligrams per square centimeter that given excellent protection in marine environments.

The ingredients of the bath of the foregoing example can vary as follows:

| | |
|---|---|
| Magnesium | 0.4 to 1.7, preferably 0.9 to 1.4 mols per liter |

-continued

| | |
|---|---|
| Chromate ion | 0.2 to 1, preferably 0.4 to 0.8 mols per liter |
| Phosphate ion | 0.7 to 4, preferably 1.5 to 3.5 mols per liter |
| Resin | 2 to 14, preferably 3 to 10 g per liter |

Coating weights above about 0.5 milligram per square centimeter tend to craze, and below about 0.2 milligram per square centimeter are not as effective although as little as 0.05 milligram of coating per square centimeter gives noticeably improved corrosion resistance. This improvement increases with increased coating weight, and two coats can be used if desired, as by going through a second such coating treatment after a first coating is applied and cured, to make a total chromate-type coating weight of about 1 milligram or more per square centimeter.

It is simpler to apply heavy coatings of the foregoing type by first applying to the aluminized surface a porous adherent layer of essentially inert colloidal particles of refractory solid such as alumina to provide a sponge-like substrate for the final magnesium-chromate-phosphate-resin coating layer. In this way a sponge-like preliminary layer weighing about 1/10th to about 4/10ths milligrams per centimeter can receive in one spray or dip application for example enough of a magnesium-chromate-phosphate-resin layer to make a combined coating weight of about 6/10ths to about 1 milligram per centimeter over the aluminum without crazing and with very good corrosion resistance. However such combined layers provide excellent resistance to marine atmospheres at high temperatures when these coatings weigh as little as 4/10ths or even 3/10ths milligrams per centimeter.

Also the sponge-like substrate layer can additionally contain some or all of the ingredients in the magnesium-chromate-phosphate-resin top layer. The addition of such ingredients increases the adhesion of the sponge-like substrate layer to the aluminized surface.

The following is an example of such a compound coating:

EXAMPLE II

The aluminized metal here treated is 410 stainless steel diffusion coated in a pack that provided a case 0.0006 inch thick. This coating was effected in a powder pack mixture of 20% aluminum, and 80% aluminum oxide, both minus 325 mesh. The diffusion retort was of doughnut shape having an outer diameter of 30 inches and an inner diameter of 8 inches, its height being 24 inches. Compressor blades of the foregoing stainless steel were imbedded in the aluminum-alumina pack mixture, and six perforated tubes of the same stainless steel 2 inches in diameter and 20 inches high filled with an energizer mixture were uniformly inserted in the pack and distributed around the doughnut. The energizer mixture was a pack containing 3% anhydrous aluminum chloride, and the total amount of anhydrous aluminum chloride corresponding to about 0.2% of the entire pack. A perforated cover was placed on top of the retort and the retort so covered enclosed is a protective shell through which a stream of hydrogen was slowly flushed. The aluminizing was conducted for 20 hours at a temperature of 885°F.

The resulting aluminized blades were lightly vapor honed with a dispersion of fine aluminum oxide in water, and then dipped in an aqueous dispersion of colloidal alumina containing 15% alumina particles 5 millimicrons in size. The dipped blades were removed from the mixture, permitted to drain, blown with a jet of air and air dried at room temperature. The resulting film weighed about 0.2 milligrams per square centimeter.

Over the air dried layer was then sprayed a mixture prepared by dissolving to make up to 1 liter in water the following ingredients:

31 g. $CrO_3$
16.5 g. $MgCr_2O_7$
162 g $Mg(H_2PO_4)_2$
3.2 g Dispersed polytetrafluoroethylene and the sprayed material baked at 700°F for 30 minutes. The amount of spray was such that the aluminum surface carried a total weight of 0.5 milligram per square centimeter, and the final product showed no crazing and excellent resistance to corrosion. Even such dual coatings weighing as much as 1 milligram per square centimeter showed no crazing.

Similar results are obtained when the colloidal alumina mixture contains any or all of the other top coat ingredients listed above. Also the amounts of those ingredients can be varied as for example by doubling the amount of $Mg(H_2PO_4)_2$. It may be desirable to add dispersing agents to the alumina dispersion to stabilize it when the top coat ingredients are added. The dispersion is preferably somewhat acid even before those ingredients are added.

In addition, the colloidal aluminum particles can be varied in size and can be replaced by non-dispersed dry alumina powder which is simply spread over the surface of th substrate. Indeed very fine dry powder will satisfactorily adhere to such surface when the surface is merely dipped into a bed of the powder. Such adhesion also takes place when the substrate is inserted in a floating bed of the powder. The alumina can also be replaced by silica or magnesia, although the dual coatings in which alumina is used are much harder and much more erosion-resistant. The alumina can also be replaced by sodium aluminate. When acid ingredients are added to the sodium aluminate, it is converted to colloidal alumina.

The increased hardness contributed by the alumina makes it also desirable to use as a layer over a silica base layer, before the magnesium-chromate-phosphate-resin coating is applied.

The aluminizing of age-hardenable and martensitic stainless steel compressor blades that are built up of segments brazed together, can adversely affect the braze where the brazing alloy contains more than about 5% of a metal such as zinc melting below 650°C. For the purpose of reducing this adverse effect the surface of the brazing can be covered with a protective film of nickel for example. Such film greatly reduces the penetration of aluminum as well as the weakening of the braze caused by the penetration.

The application of such a protective film over the entire compressor blade or over any portion of the blade surface other than the braze itself, will also keep that filmed surface from being properly aluminized. Confining the protective film to the braze alone is arranged by pretreating the blade so as to subject the surface to oxidation and to a conversion type coating. One way to do this is to dip the blade into the following solution:

665 grams NaOH
20 grams $NaNO_3$
20 grams $CrO_3$
Water to make a total of 1000 cc.

Removing the dipped blade and allowing it to drain and then heating it in an oven at 280°F for 10 minutes. The entire blade becomes a little oxidized and covered with a stratum that renders it somewhat non-reactive. The blade is then dipped in dilute (5 to 10% by weight) aqueous nitric acid and a nickel plating is then applied as by chemical deposition from aqueous solution in the manner described in U.S. Pat. 3,532,283, 2,822,293 and 2,822,294. The nickel plating is only formed on the surface of the braze, the remaining surfaces of the blade being substantially unaffected by the plating treatment.

A similar restricted nickel plating is produced by electrolytic deposition using standard electrolytic nickel plating baths and plating conditions.

The blade with the nickel plated braze is then subjected to aluminizing as described in Example II for instance, and after the aluminizing is completed the braze will be much less affected by penetration of aluminum. It is not necessary to clean off the conversion coating or the oxidized surface from the blade, although these can be done if desired using dilute (e.g. 2N) aqueous sulfuric acid for this purpose. The high temperature reducing condition under which diffusion coating is carried out automatically cleans up non-metallic matter on the surfaces being coated.

Other oxidative conversion coating treatments can also be used, so long as the blade surface is subjected to the action of mixtures containing phosphate as well as chromate, and to temperatures sufficiently high, generally above 212°F. Any iron base alloy containing at least 10% chromium is rendered relatively inert by such oxidative conversion treatment.

First stage turbine vanes of cobalt-base or nickel-base superalloys that have been aluminized with either the complex or simple aluminizing, are also improved by heating in air at 2050° to 2100°F until their surface is uniformly whitened, generally about 10 to 20 hours, then glass blasting after cooling to remove the white skin (which appears to be aluminum oxide). The resulting vane looks very much like the untreated aluminized vane, except for a loss of some color where the vane is a cobalt-base superalloy like WI 52, but the aluminized case is more adherent and less subject to spalling and the like on handling. Where the case is damaged it can be stripped off by the processes described in U.S. Pat. Nos. 3,622,391 granted Nov. 23, 1971 and 3,458,353 granted July 29, 1969. Those processes are further improved by modifying the aqueous HF—$HNO_3$ stripping baths thus used so that $CrO_3$ is also present in those baths. A solution of 15 g HF, 80 g $HNO_3$ and 5 g $CrO_3$ in 920 g water makes a very effective stripping bath for this purpose when used at 85°F. The aluminized case dissolves in the bath and the base metal is not significantly attacked. Polished surfaces of the substrate survive the stripping bath treatment without much loss of polish.

The $CrO_3$-containing stripping baths can also contain other ingredients that do not detract from its effectiveness. Ammonium, alkali metal and alkaline earth metal cations as well as acetate and phosphate anions are examples of such allowable addition to the baths. In general the HF content can vary from about 0.1 to 5% by weight, the $HNO_3$ content 3 to 20% by weight, and the ratio of HF to $CrO_3$ from 15:1 to 1:5 by weight. Preferred ranges are

| | |
|---|---|
| HF | 0.5 to 3% |
| $HNO_3$ | 5 to 15% |
| $HF:CrO_3$ | 7:2 to 1:2 |

all calculated by weight. All of the stripping baths work well at from 50° to 140°F.

Any attack on the superalloy based caused by the $CrO_3$-containing or $CrO_3$-free baths is further minimized by keeping the work piece being stripped in contact with metallic nickel or cobalt. Thus the stripping can be carried out by placing the work pieces to be stripped and the stripping bath in a nickel-surfaced container, or holding the work pieces in a nickel wire mesh basket while they are dipped in the stripping bath. Pickling inhibitors can also be added to the stripping bath.

Obviously many modifications and variations of the present invention are possible in the light of the above teachings. It is, therefore, to be understood that within the scope of the appended claims the invention may be practiced otherwise than as specifically described.

What is claimed:

1. A method for protecting aluminum-diffusion-coated martensitic or age-hardenable stainless steel, which method comprises applying to the diffusion coated surface a porous adherent layer of essentially inert colloidal particles of refractory solid then applying on said porous layer a layer consisting essentially of an aqueous solution of chromic acid, phosphoric acid and the magnesium salts of said acids, the solution containing dispersed particles of polytetrafluoroethylene resin less than one micron in size, the magnesium being in a concentration of about 0.9 to about 1.4 mols per liter, the chromate ion concentration about 0.4 to about 0.8 mol per liter, the phosphate ion concentration about 1.5 to about 3.5 mols per liter, and the resin concentration about 3 to about 10 grams per liter and calcining the combination, the first layer weighing about 0.1 to about 0.4 milligrams per square centimeter of surface when dry, and the second layer being made sufficiently heavy so that the combined layers when cured weigh at least about 0.4 to about 1 milligram per square centimeter of surface.

2. The combination of claim 1 in which the refractory solid is alumina and it is applied in the form of an aqueous dispersion and dried.

3. The combination of claim 2 in which the second layer is sprayed on, and the stainless steel that is coated is a jet engine compressor blade.

4. A jet engine compressor part of martensitic or age-hardenable stainless steel having an aluminum diffusion coating on its surface, the diffusion coating being covered by the method of claim 1.

* * * * *